US008465253B2

(12) United States Patent
Adler

(10) Patent No.: US 8,465,253 B2
(45) Date of Patent: Jun. 18, 2013

(54) PUMP HOUSING WITH TWO-POINT MOUNT

(75) Inventor: Andreas Adler, Schwerte (DE)

(73) Assignee: Wilo AG, Dortmund (DE)

( * ) Notice: Subject to any disclaimer, the term of this patent is extended or adjusted under 35 U.S.C. 154(b) by 1141 days.

(21) Appl. No.: 12/093,968

(22) PCT Filed: Nov. 14, 2006

(86) PCT No.: PCT/EP2006/010875
§ 371 (c)(1),
(2), (4) Date: May 16, 2008

(87) PCT Pub. No.: WO2007/062742
PCT Pub. Date: Jun. 7, 2007

(65) Prior Publication Data

US 2008/0317592 A1 Dec. 25, 2008

(30) Foreign Application Priority Data

Dec. 3, 2005 (DE) ..... 10 2005 057 858

(51) Int. Cl.
*F04D 29/60* (2006.01)

(52) U.S. Cl.
USPC ..... 415/200; 415/213.1

(58) Field of Classification Search
USPC ..... 415/206, 213.1, 214.1, 200
See application file for complete search history.

(56) References Cited

U.S. PATENT DOCUMENTS 5,344,286 A * 9/1994 Schafer et al. ..... 415/213.1
5,478,215 A * 12/1995 Kobayashi et al. ..... 417/423.14
6,264,831 B1 * 7/2001 Hawkins et al. ..... 210/86
7,150,606 B2 * 12/2006 Bonfardeci et al. ..... 417/417

FOREIGN PATENT DOCUMENTS

EP 0774583 5/1997
EP 1413769 4/2004
GB 2186027 * 8/1987

OTHER PUBLICATIONS

Sanjay Sharma, University of Plymouth (Course Notes—Engineering Drawing and CAD), Oct. 2010, 53 pages (see pp. 23 of 53).*

* cited by examiner

*Primary Examiner* — Edward Look
*Assistant Examiner* — Liam McDowell
(74) *Attorney, Agent, or Firm* — Andrew Wilford

(57) ABSTRACT

A pump housing of a rotary pump has a pump chamber in which an impeller can rotate, an intake port, an output port similar to the intake port, the intake and output ports having respective axially oppositely directed flanges centered on a flange axis, and respective unitary projections on the flanges each formed with a respective flat extending parallel to the flange axis. The flats form only two axially spaced mounting points for securing the pump to a support surface extending parallel to the axis.

13 Claims, 4 Drawing Sheets

Fig. 1 - Prior Art

PUMP HOUSING WITH TWO-POINT MOUNT

CROSS REFERENCE TO RELATED APPLICATIONS

This application is the US national stage of PCT application PCT/EP2006/010875, filed 14 Nov. 2006, published 7 Jun. 2007 as WO 2007/062742, and claiming the priority of German patent application 102005057858.6 itself filed 3 Dec. 2005, whose entire disclosures are herewith incorporated by reference.

FIELD OF THE INVENTION

The present invention relates to the housing of a pump, particularly a rotary pump, having means for securing the pump to a support surface, a pump chamber in which an impeller can rotate, an intake port, and an output port similar to the intake port, the intake port and the output port each having a flange and the flanges being centered on a common flange axis.

BACKGROUND OF THE INVENTION

In the integration of electrically driven pumps into pipe systems, the pump housing has to be mounted on a surface, such as a wall, a rack, or a support profile. This requirement exists not only because the pump and the electric motor would place a heavy load on the pipes of the pipe system and the respective pipe connections connected thereto without any other support, due to its dead weight, but vibrations may also occur in a rotary pump that are transferred to the pipe system via the pump housing, if the pump housing is not sufficiently statically fixed.

In order to mount the pump housing, it is known to provide at least three mounting points on the pump housing, by means of which the pump housing abuts the support surface, and on which fasteners are incorporated, at which the pump housing engages the support surface. For this purpose, it is common in order to get the most stability to orient the three mounting points such that they form the corners of a triangle. However, the spacing of the mounting points may vary from pump to pump such that changing or replacing the pump with a different type of pump is not possible without great installation expense. Generally, specific mounting measurements and spacings of the mounting points are necessary at the support surfaces for each pump type.

It is common to provide the mounting points on the pump chamber of the pump, the spacing of the mounting points also depending on the size and the output of the pump due to the fact that the pump chamber differs in size and shape depending on the nominal rating of the electrically driven pump. However, it is also known to provide the mounting points at the neck of a port, and/or to provide an additional mounting point at the side of a flange facing the pump chamber for static stabilization. The number, location, and distance of the mounting points are therefore dependant on the design, type, installation size, and size of the pump. Another disadvantage with such pumps having three mounting points is an increased installation effort as opposed to pumps having only two mounting points.

In order to set up the mounting points according to the prior art, projections in the form of cylindrical studs projecting from the pump chamber are provided on the pump housing. The studs are made of solid material, requiring an unnecessarily high material expense. Generally, bores, or M10 threaded bores, are incorporated into the studs, into which fasteners can be inserted.

OBJECT OF THE INVENTION

The object of the present invention is to provide a pump housing that can be fixed using only two mounting points on a support surface, whereby a saving of material is possible by omitting the conventional studs, and a standardized installation size is established by means of a suitable spacing of the mounting points such that replacement of a pump by another pump having any desired pump chamber form and size is easily facilitated, and possible at a low material expense.

SUMMARY OF THE INVENTION

This object is attained in which the housing has only two mounting points for securing the pump to a support surface, each mounting point being on a respective one of the flanges and each flange having at least one unitary projection or flat directed toward the support surface.

Electrically driven pumps for integration into existing pipe systems generally have an intake port and an output port similar to the intake port, onto each of which a flange is unitarily formed. The flanges serve for securing the pump to corresponding counter flanges of the piping system normally by screwing them together, for example. The flanges are centered on a common flange axis as a result of which such pumps are also referred to as "inline pumps." Such generic pumps are cast in one piece of a material such as steel or iron. In the following the pump housing is to be understood as the entirety of the pump, particularly consisting of the pump chamber, the intake port and output port, and the flanges associated therewith. Such a pump according to the prior art is shown in FIG. 1.

According to the invention, the saving on installation expense for mounting a generic pump in an existing pipe system and fixing of the pump on a support surface is achieved in that the pump housing has only two mounting points that engage support surfaces and have fasteners that fix the housing to the support surface.

Standardized installation sizes, particularly within product series of different types of pumps, are achieved by means of the invention in that the mounting points are provided on the flanges. By standardizing the flange spacing, the standardization of the pump mounting can be achieved in this manner. The dimensions of pump flanges are standardized according to DIN-EN 1092. Insofar as equal spacings of the two flanges always exist within a pump series, the replacement of a pump is always easily possible without any problems, since no new mounting points must be provided on the support surface, but instead, the mounting points of the previous pump can be reused. If the spacing of the two flanges is consistently maintained by all types of pumps by one manufacturer, the largest possible flexibility in replacing pumps is obtained, particularly due to the independence of the mounting points of the size and design of the pump chamber and/or of the studs.

The substantial advantage of the housing according to the invention having two mounting points, namely simple installation, reduction of material, and standardization of mounting dimensions, is theoretically accompanied by the disadvantage that due to having only two mounting points on the flanges, the pump housing, together with the electric motor, is left with an addition degree of freedom in its direction of movement, which could lead to a statically more unstable fixation than with three-point mounting, which in turn could result in an increased susceptibility of vibration. This becomes obvious especially, if the pump housing is seen from the top in line with the flange axis, when the flanges engage a support surface.

If an orthogonal plane to the support surface is assumed, in which the flange axis is positioned, the pump housing together with the electric motor could a move perpendicular to this plane, e.g. to the sides of the plane. To overcome this disadvantage, which has thus far kept the person skilled in the art from using only two mounting points, the abutment faces provided on the flanges could be made fairly wide. In addition, and as an alternative, a stronger fastener can be utilized. For example, an M12 threaded bore can be provided on the mounting point, which cooperates a corresponding fastener and which ensures an better static fixation than is possible with the use of M10 threaded bores.

In light of the fact that flanges are made substantially round, each flange may have at least one flat face, or at least one unitary projection directed toward the support surface in order to form a mounting point. In a preferred embodiment of these support surfaces, the unitary projections may have faces that are directed toward the support surface, and that can abut same, which are positioned on a tangential plane of the outer edge of the respective flange. This has the advantage that only a minimum of cast material must be used in order to create the support surface. As an alternative, this face may also significantly protrude from the flange edge such that the face lies on a plane parallel to this tangential plane. In this manner, the spacing of the pump housing to the support surface may be freely selected.

In an alternative embodiment, the flanges may also have flats each forming a face directed toward the support surface, and engaging same, this face also being positioned preferably on a plane parallel to the tangential plane of the outer edge of the respective flange. As an alternative, the faces formed by flat faces, or by means of the projections, may also be made parallel to the support surface, thus making any desired skew installations of the pump housing opposite the support surface possible.

According to the invention, at least one bore, particularly a threaded bore, positioned in the flange plane, may be inserted into each flange for receiving a respective fastener. A flange plane is to be understood as that plane into which the respective flange extends, or on which the diameter of the respective flange lies. The bore may be lined with a female thread. In an embodiment without a female thread, a fastener is preferably inserted or cemented into the bore. Using a threaded fastener makes such use of cement unnecessary. Instead, a fastener having a male thread can be screwed into the threaded bore, by means of which the pump housing can be fixed to the support surface. In this regard, the mounting point may also have several, for example, two bores, whereby higher stability of the mount is achieved, particularly with heavy electrically driven pumps having thick and wide flanges.

If a bore is used, the same may preferably extend radially toward the flange axis such that the best possible static fixation of the pump housing is obtained by means of this one bore.

Preferably, the bores may be made of M12 threaded bores, and may preferably extend between 20 mm and 50 mm, in the case of flats, particularly 30 mm deep into the respective flange. A strong hold of the fastener is ensured on the flange in this manner.

In order to increase the stability of the flange mounting, the flanges may be extended on their side facing the pump chamber, which may extend at least along part of the side of the respective flange facing the pump chamber, these unitary extensions each having a face directed toward the support surface such that this face forms a combined abutment face together with the face of the respective unitary projection, or the respective flat, respectively, to engage the support surface.

In order to calculate the lowest possible material expense for these unitary extensions, they may be convexly arced parallel to the flange axis toward the pump chamber. Furthermore, this convex arc of a unitary extension may be made in a preferred embodiment variation such that a circle may be geometrically inscribed into the combined abutment face, having a diameter, for example, between 15 mm to 35 mm, preferably 25 mm. Such a shape of the unitary extension ensures that the wall thickness between the bore and the respective outer face of the flange is sufficiently large all over in order to achieve sufficient stability of the mounting. This is particularly achieved according to the invention, in that the axis of the bore extends through the center point of a circle inscribed in the overall abutment face.

In order to obtain a standardized installation size, the center points of these virtual inscribed circles may each have a definable spacing from the face of the flanges opposite the pump chamber, or from the surface of the sealing faces of the flanges. The sealing faces generally form concentric raised regions provided on the side of the flanges opposite the pump chamber, the axis of a bore may be spaced from the face of the respective sealing face between 10 mm and 20 mm, preferably between 14 mm and 16 mm, or between 7 mm and 17 mm, may preferably be spaced from the face of the respective side of the flange opposite the pump chamber between 11 mm and 13 mm. The convex arc of the unitary extensions can be set according to this definition of the center point of the circle in dependence on a face of the flange opposite the pump chamber.

The width of the face that can engage the support surface or the combined abutment face of the flanges with unitary projections may be preferably selected depending on their size, particularly depending on the diameter of the respective flange. Preferably, however, this width may be between 30 mm and 80 mm, preferably 50 mm.

For particularly simple manufacture of the pump housing according to the invention, the unitary projections and the unitary extensions may be connected to the flanges in one piece. Preferably, the unitary projections and the unitary extensions may be formed directly during the casting process of the pump housing. The pump housing according to the invention is therefore produced by casting, particularly of cast iron in a particularly advantageous embodiment.

BRIEF DESCRIPTION OF THE DRAWING

Further advantages and characteristics of the invention are obvious from the dependent claims and the following detailed description based on FIGS. 1-4. Therein:

DETAILED DESCRIPTION

Figure 1:
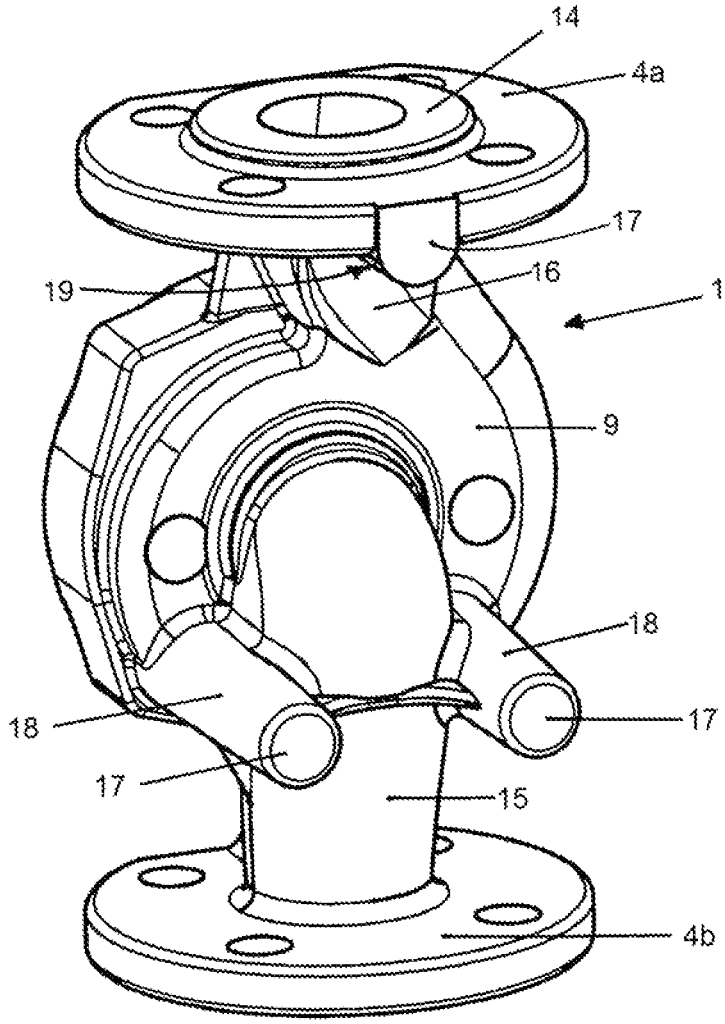
FIG. 1 shows a pump housing according to the prior art, having three mounting points.

FIG. 1 shows a pump housing according to the prior art, as has been described above. In order to form mounting points 17, the pump housing 1 has substantially cylindrical unitary studs 18 tapering conically toward an unillustrated support surface, and a narrow unitary extension 19 provided at the flange 4*a* of the output port 16. The studs 18 are made of solid material, and form the body for receiving a fastener (not shown). Such a pump housing 1 can be mounted, for example, on a wall.

Figure 2:
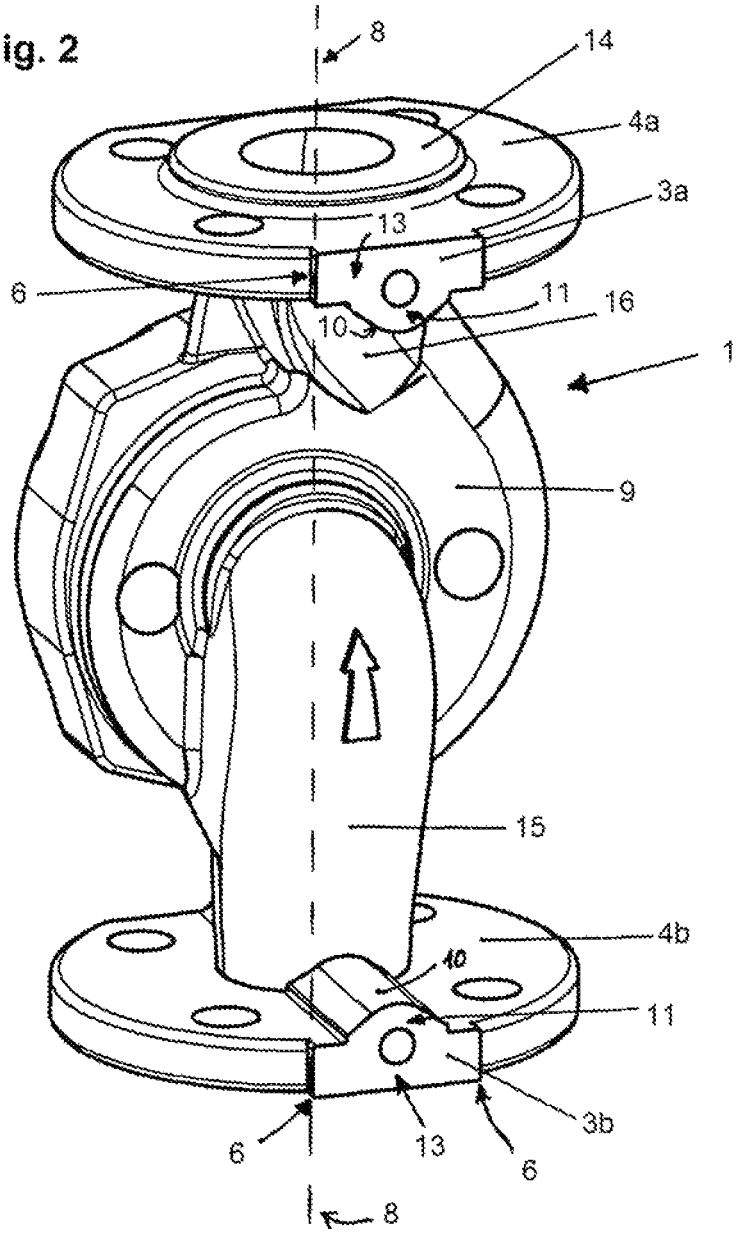
FIG. 2 shows a pump housing according to the invention, having two mounting points.
Figure 6:
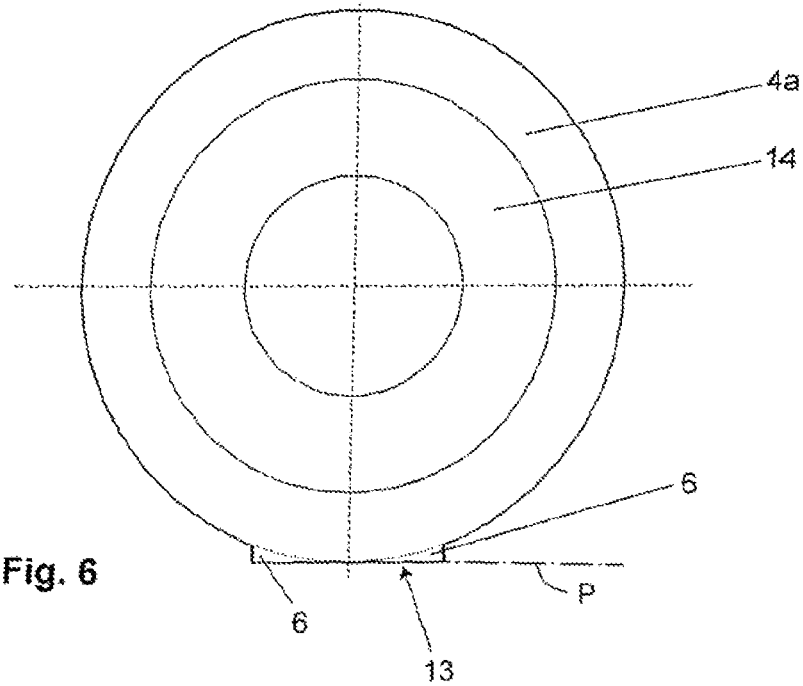
FIG. 6 is a top view of the flange of the output port, having two unitary projections.

FIG. 2 shows an embodiment of the pump housing 1 according to the invention, where one such unitary projection 6 is provided both at the flange 4*a* of the output port 16, and at the flange 4*b* of the intake port 15, both directed toward the support surface, each flange 6 having a planar face turned toward the support surface and forming a respective mounting point 3*a*, 3*b*. In the embodiment according to FIG. 2, the unitary projections 6 are made such that the planar face 13 lies on a plane P extending tangentially to the outer edge of the respective flange 4*a*, 4*b*. In this regard reference is made to FIG. 6, which shows a view of the flange 4*a* of the output port 16 from the top, clearly showing in FIG. 6 that due to the position of the face 13 on the tangential plane P two unitary projections 6 are required for to make it, since no protruding flange material is present at the point where the plane P tangents the outer edge of the flange 4*a*.

Figure 7:
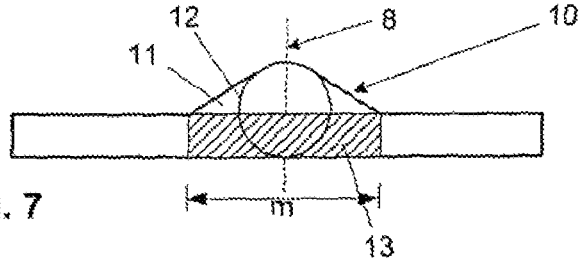
FIG. 7 is a top view of the flange of the intake port, having a combined abutment face.

FIG. 2 further shows that the two flanges 4*a*, 4*b* each have unitary extensions 10 on the sides turned toward the pump chamber 9, each extending radially from the flange axis 8 toward the outer edge of the respective flange along the side of the respective flange 4*a*, 4*b* facing the pump chamber 9. The unitary extensions 10 unitarily merge with the necks of pressure and intake ports 15 and 16. The unitary extensions 10 each form a planar face 11 directed toward the support surface, which is in the same plane P as the face 13 of the respective unitary projection and which forms a combined abutment face 11+13 together with the face 13 of the unitary projections 6. This is schematically shown in FIG. 7. The convex arc of the unitary extensions 10 toward the pump chamber 9 in a direction parallel to the flange axis 8 can be seen in FIGS. 2 and 7.

Figure 5:
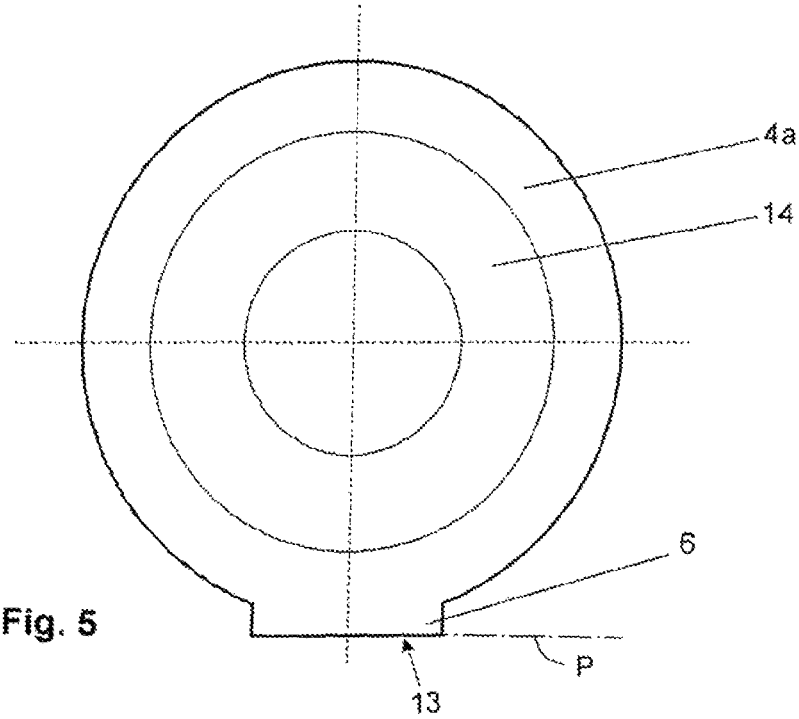
FIG. 5 is a top view of the flange of the output port, having one unitary projection.

An alternative embodiment of the unitary projections 6 is shown in FIG. 5, where the unitary projection 6 associated with each flange 4*a* significantly projects from the outer periphery of the flange 4*a* such that the planar face 13 directed toward the support surface lies on a plane parallel to the tangential plane P at the outer edge of the flange 4*a*.

Figure 3:
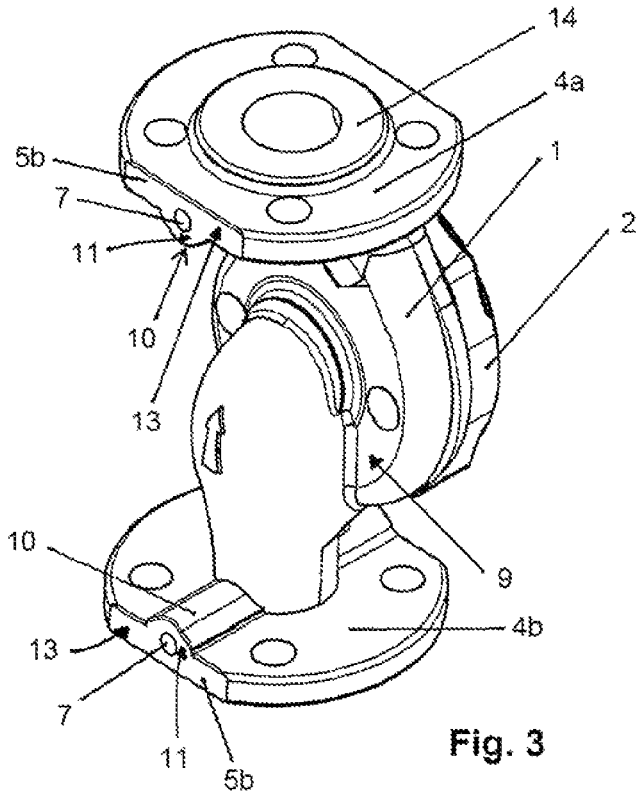
FIG. 3 is a perspective view of a pump housing according to the invention with flattened flanges.

A second embodiment of the pump housing 1 according to the invention is shown in FIG. 3. The mounting points 5*a* and 5*b* of both flanges 4*a* and 4*b* are formed by flats that are each directed toward the support surface. Faces 13 that can engage the support surface in the area of the flange edges are formed by the flats 5*a* and 5*b*. Furthermore, these faces 13 form a combined abutment face 13+11 that can engage the support surface, together with the face 11 of the unitary extension 10 that is also created by means of the flat 5*a* and 5*b*. FIG. 3 also shows an outline of the electric motor 2 driving the pump.

Figure 4:
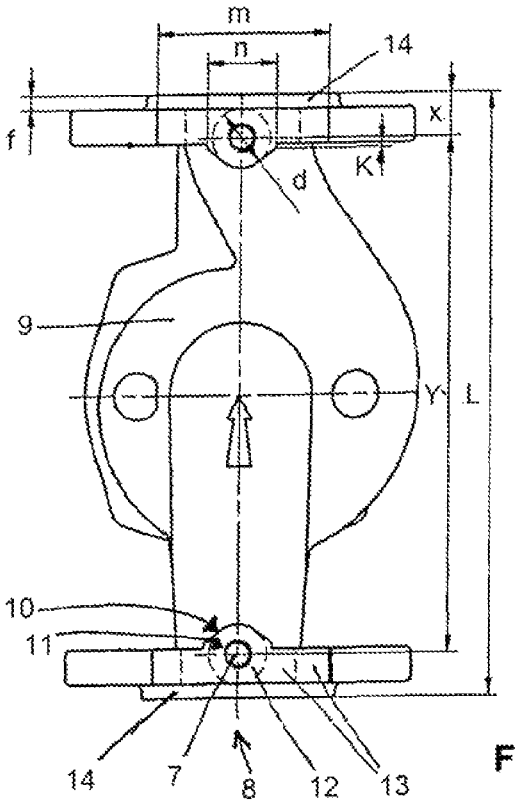
FIG. 4 is a front view of the pump housing according to FIG. 3.

FIG. 4 shows a front view of the pump according to the invention of FIG. 3, where the abutment faces 13 formed by the flats 5*a* and 5*b* can be seen. The convex arc of the edge of the unitary extensions 10 is such that a circle 12 can be inscribed around the edge of the abutment face 11 formed by the unitary extension 10 and extending across the abutment face 13 of the flat 5*a*, 5*b* and centered on the flat, the circle having a diameter d. This diameter d is 25 mm according to the embodiment shown in FIG. 4. The axis of the bore 7 extends through the center point of this circle 12 of a combined abutment face 13+11. The convex arc of the unitary extension 10 conforms to the outer circumference of the circle and forms the convex arc. The flats 5*a* and 5*b* have a width m that depends on the diameter of the flange. The width m is determined by the spacing of the flats 5*a* and 5*b* from the flange axis 8. For design reasons, the flat 5*a* and 5*b* must be symmetrical so that a flange also has a flat facing the electric motor 2, see FIG. 3.

With the use of unitary projections 6 for the embodiment of the mounting points 3*a* and 3*b*, the width m of the abutment face 13 should also be selected according to the diameter of the flange (FIG. 7). With a flange diameter of 140 mm to 150 mm, the width m may, for example, be 50 mm, with a flange diameter of 165 mm to 185 mm, the width m may be 60 mm, or with a flange diameter of 200 mm to 220 mm, the width may be m=70 mm.

In the embodiment according to FIG. 4 the unitary extensions 10 have a width n, which is preferably 30 mm with a diameter d of the circle 12 of 25 mm. As shown in FIG. 4, the convex arc of the unitary extensions 10 can be made, initially in steps from the side of the flanges 4*a*, 4*b* facing the pump chamber 9, at a step height k of, for example, 2 mm, the convex arc merging with the stepped edge.

The center point of the circle 12 has a spacing X from the face of the seal surface 14, in this case preferably between 14 mm and 16 mm, and can be selected independently of the flange diameter. The pump housing length L is dependent on the diameter of the flanges, and is between 220 mm and 360 mm with flanges between 140 mm and 220 mm.

The invention claimed is:

1. In combination with a support surface, a pump housing of a rotary pump having:

a pump chamber in which an impeller can rotate, an intake port, an output port similar to the intake port, the intake port and the output port having respective axially oppositely directed flanges centered on a flange axis parallel to the support surface, and respective unitary projections on the flanges each formed with a respective planar flat extending parallel to the flange axis and each in turn formed with a respective bore open at the respective flat and adapted to receive a respective fastener, the flats each forming a mounting point for securing the pump to the support surface with the flats bearing on the support surface, the flanges having on their sides facing the pump chamber unitary extensions that each extend from the flange axis to the outer edge of the respective flange along at least part of the side of the flange facing the pump chamber, the unitary extensions each having a face parallel to the support surface such that this face forms, together with the flat of the respective unitary projection, a combined abutment face that abuts the support surface.

2. The pump housing defined in claim 1, wherein the bores each open on the face of the respective unitary extension and on the flat of the respective unitary projection.

3. The pump housing defined in claim 1, wherein the flanges are circular and centered on the axis and the respective flat of each of the unitary projections is directed toward the support surface, engages thereagainst, and lies on a tangential plane of an outer edge of the respective flange or on a plane parallel to this tangential plane.

4. The pump housing defined in claim 1, wherein the respective flat of each of the unitary projections is directed toward the support surface, engages thereagainst, and lies on a flange plane that is parallel to a tangential plane of an outer edge of the respective flange.

5. The pump housing defined in claim 4, wherein the flanges have respective sealing faces that form concentric raised regions on sides of the respective flanges opposite the pump chamber, the mounting points each being formed with a respective bore centered on a respective axis at a spacing from the surface of the respective sealing face between 10 mm and 20 mm from a face of the respective side of a flange opposite the pump chamber.

6. The housing defined in claim 5, wherein a width of the combined abutment face that can engage the support surface is between 30 mm and 80 mm.

7. The pump housing defined in claim 1, wherein each bore is directed radially of the flange axis.

8. The pump housing defined in claim 1, wherein the bores are threaded and extend between 20 mm and 50 mm into the respective flange.

9. The pump housing defined in claim 1, wherein the unitary extensions are convexly arced toward the flange axis and toward the pump chamber.

10. The pump housing defined in claim 9, wherein the convex arcs of the unitary extensions are each formed such that a circle inscribed in the combined abutment face has a diameter between 15 mm to 35 mm.

11. The pump housing defined in claim 10, wherein each abutment face is formed with a respective bore centered on an axis extending through a center point of the inscribed circle of the combined abutment face.

12. The pump housing defined in claim 1, wherein the pump housing is of cast iron.

13. In combination with a support surface, a pump housing of a rotary pump having:

a pump chamber in which an impeller can rotate, an intake port, an output port similar to the intake port, the intake port and the output port having respective axially oppositely directed flanges centered on a flange axis parallel to the support surface, and respective unitary projections on the flanges each formed with a respective planar flat extending parallel to the flange axis and each in turn formed with a respective bore extending perpendicular to the respective flange axis, open at the respective flat, and adapted to receive a respective fastener, the flats each forming a mounting point for securing the pump to the support surface with the flats bearing on the support surface, the flanges having on their sides facing the pump chamber unitary extensions that each extend from the flange axis to the outer edge of the respective flange along at least part of the side of the flange facing the pump chamber, the unitary extensions each having a face parallel to the support surface such that this face forms, together with the flat of the respective unitary projection, a combined abutment face that abuts the support surface.

* * * * *